US005947561A

United States Patent [19]

Ryan

[11] Patent Number: 5,947,561

[45] Date of Patent: Sep. 7, 1999

[54] ADJUSTABLE TANNING CHAIR APPARATUS

[76] Inventor: Sandra H. Ryan, 7823 Niagra Ave., Tampa, Fla. 33617

[21] Appl. No.: 09/070,057

[22] Filed: Apr. 30, 1998

[51] Int. Cl.[6] ..... A47C 1/10

[52] U.S. Cl. ..... 297/391; 297/900; 297/183.5

[58] Field of Search ..... 297/900, 391, 297/392, 31, 16.1, 183.1, 183.5, 29, 34, 51, 53, 54, 403, 354.13

[56] References Cited

U.S. PATENT DOCUMENTS 4,606,086 8/1986 Rowland .
5,121,969 6/1992 Schroeder .
5,297,850 3/1994 Guleserian .
5,466,039 11/1995 Umbrianna .
5,624,157 4/1997 Kostuk .

*Primary Examiner*—Milton Nelson, Jr.

[57] ABSTRACT

A lounge chair apparatus for allowing a person to lye in either a prone, supine, or sit in an upright position at varying degrees. The lounge chair apparatus comprising an upper platform, a middle platform, and a lower platform. A pair of U-shaped configuration formed by a plurality of support member is affixed thereto the upper platform. An elongated slot is formed therebetween the U-shaped configurations to allow a person's face to be supported therebetween. A carrying handle is affixed thereto the U-shaped configurations to allow a person to carry the chair apparatus when in a folded position.

10 Claims, 8 Drawing Sheets

ADJUSTABLE TANNING CHAIR APPARATUS

BACKGROUND OF INVENTION

1. Field of the Invention

Generally, this invention is directed toward providing a lounge chair for allowing a person to obtain a sun tan or just relaxing. More specifically, this invention provides a lounge chair having a cushioned opening in an upper part of the lounge chair to allow a person to lye comfortably in either a prone or supine fashion and also allowing a person to sit in an upright position at varying degrees.

2. Description of the Prior Art

One of the problems noticed when a person lyes in a prone fashion to sunbathe or to relax on a conventional lounge chair is the difficulty in breathing. Breathing becomes a difficult task because the nose and mouth portions of the face are obstructed by the surface of the conventional lounge chair. To compensate for this problem, a person typically looks in an upward fashion or to the sides thereby bending the neck portion such that the person is allowed to breathe more freely. However, after short periods of time, the neck muscles will be strained and the person can develop hypertension of the neck muscles.

Another problem associated with sun bathing or relaxing on lounge chairs is the excessive heat that is accompanied with solid surface lounge chairs. Airflow is normally impeded from flowing under and around a person's body and can provide an uncomfortable environment while sun bathing for long periods of time.

Several approaches have been provided for allowing a person to lye on his stomach in either a prone or supine fashion, in Grahl of U.S. Pat. No. 4,535,878, "A pillow-tote bag (A) is illustrated for use at the lake or beach for carrying accessory devices and for providing a face and head rest for a person either in a prone or a supine position. The bag device (A) includes a pillow panel (10) and a pocket panel (12). The pillow panel (10) advantageously includes a bifurcated pillow (B) having a first pillow cushion (20) and a second pillow cushion (22). The pillow cushions are bifurcated for access to an air mask (36) so that a person may breathe comfortably in a supine position. The bifurcated pillows may be joined together and the air mask closed to provide a cradle (48) and unitary pillows for supporting the head when a person is lying in supine position. A spine member (16) maintains the bag device in a non-sagging configuration when used as a tote. Pockets (60) carried in the pockets panel (12) are maintained in a straight configuration due to the non-sagging configuration of the bag."

In Finkelstein of U.S. Pat. No. 4,891,854, "A support assembly designed to be mounted on or used directly in combination with a lounge chair or like structure to facilitate the face-down reclining of a person on the lounge chair in order to exposed his back to the sun's rays without hypertension of the neck. The support assembly includes a base extending transversely across preferably a backrest portion of the lounge chair and has an opening formed therein having a specifically structured periphery which confronts the face of the user in a manner which allows a major portion of the surface of the face including the nose, mouth, etc. to pass therethrough."

In the art taught by Rowland of U.S. Pat. No. 4,606,086, "An improved lounge chair to support a person adjustable from sitting to a prone position, the portion of said chair supporting the person's upper body having an opening provided therein large enough so that when a person's face is placed against the opening, the eyes, nose and mouth are unobstructed by any portion of the chair."

Additionally, in the Art of Lemaire, of U.S. Pat. No. 3,897,102, "The disclosure relates to a chair, more particularly, to a lounge chair which is made of a frame and a flexible material, such as canvas, associated with the frame for supporting the body of a person. The chair has a back portion which is formed with a first aperture shaped to enable a person who lies flat on his stomach to rest his head while being able to see through the first aperture. The back portion also comprises second and third apertures which are adapted to permit passing the arms of the person therethrough."

While some of the prior art may contain some similarities relating to the present invention, none of them teaches, suggest or include all of the advantages and unique features as the invention disclosed herein.

SUMMARY OF THE INVENTION

The present invention is directed toward allowing a person to lye in either a prone, supine or sitting position on a lounge chair for purposes of sun bathing or relaxing for extended periods of time. An elongated opening combined with cushions is provided that will allow the lateral sides of a person's face or cheeks to rest thereon. In addition, additional openings adjacent to the elongated opening are provided for additional ventilation purposes for cooling the person lying or sitting on the lounge chair. A protruding carrying handle is also integrated into the improved lounge chair for allowing a person to carry the lounge chair in an easy fashion when the chair is in a folded position.

Accordingly, it is an object of this invention to provide a lounge chair apparatus having an elongated opening in the upper portion of the lounge chair for allowing a person to lye comfortably in either a prone or supine position. The elongated opening has a given length on the upper portion of the chair that will allow a person of varying heights to place their head or face thereon while either in a lying or sitting position.

Another object of this invention is to provide a lounge chair with an elongated opening having a cushion means affixed thereto the parallel support members that border the elongated opening. Furthermore, the cushion means span the length of the parallel support members such that a person's face or head will be supported by the cushion means.

Still another object of this invention is to provide a protruding handle means that will facilitate carrying of the lounge chair. The handle will protrude from the lounge chair when the lounge chair is in a folded position and will allow a person to easily grasp the handle for carrying the lounge chair.

Still yet, another object of this invention is to provide a pair of vent openings adjacent to the elongated opening. The vent openings will allow air to easily flow around the head area of the person thereby cooling the person in either a prone, supine, or sitting position.

Another object of this invention is to provide a means of folding the support members to align with the cushion members thereby allowing the cushion members to extend upwards.

Still another object of this invention is to provide a means of folding the support members downward to form supporting legs.

Other objects and a fuller understanding of the invention will become apparent from reading the following detailed Description of a preferred embodiment in conjunction with the accompanying drawings.

BRIEF DESCRIPTION OF THE DRAWINGS

This invention, together with other objects, features, aspects and advantages thereof, will be more clearly understood from the following description, considered in conjunction with the accompanying drawings.

Eight sheets of drawings are furnished, sheet one contains FIG. 1, sheet two contains FIG. 2 and FIG. 3, sheet three contains FIG. 4, sheet four contains FIG. 5, sheet five contains FIG. 6, sheet six contains FIG. 7, sheet seven contains FIG. 8, and sheet eight contains FIG. 9.

LIST OF ELEMENTS

1. APPARATUS
2. UPPER PLATFORM
3. MIDDLE PLATFORM
4. LOWER PLATFORM
5. ELONGATED SLOT/FACIAL OPENING
6. FACIAL SUPPORT MEMBERS
7. FACIAL SUPPORT MEMBERS
8. VENT OPENINGS
9. VENT OPENINGS
10. TOP SUPPORT MEMBERS
11. TOP SUPPORT MEMBERS
12. SUPPORT MEMBER/LEG
13. SUPPORT MEMBER/LEG
14. CUSHION SUPPORT
15. CUSHION SUPPORT
16. RATCHET HINGES
17. RATCHET HINGES
18. RATCHET HINGES
19. RATCHET HINGES
20. VERTICAL SUPPORT LEGS
21. VERTICAL SUPPORT LEGS
22. HORIZONTAL SUPPORT LEGS
23. HORIZONTAL SUPPORT LEGS
24. HANDLE
25. HAND
26. UPPER BODY SECTION
27. MIDDLE BODY SECTION
28. LOWER BODY SECTION
29. HEAD SECTION
30. LEG TIP
31. LEG TIP
32. HINGE
33. HINGE
34. OPEN SECTION
35. DIAGONAL JOINT
36. DIAGONAL JOINT
37. ROTATING JOINT
38. ROTATING JOINT
39. OPEN JOINT 35
40. OPEN JOINT 36
41. LOCKING CAVITY
42. LOCKING CAVITY
43. EXTENDED FACIAL OPENING
44. UNDER CHAIR SPACE

DESCRIPTION OF THE PREFERRED EMBODIMENTS

Figure 1:
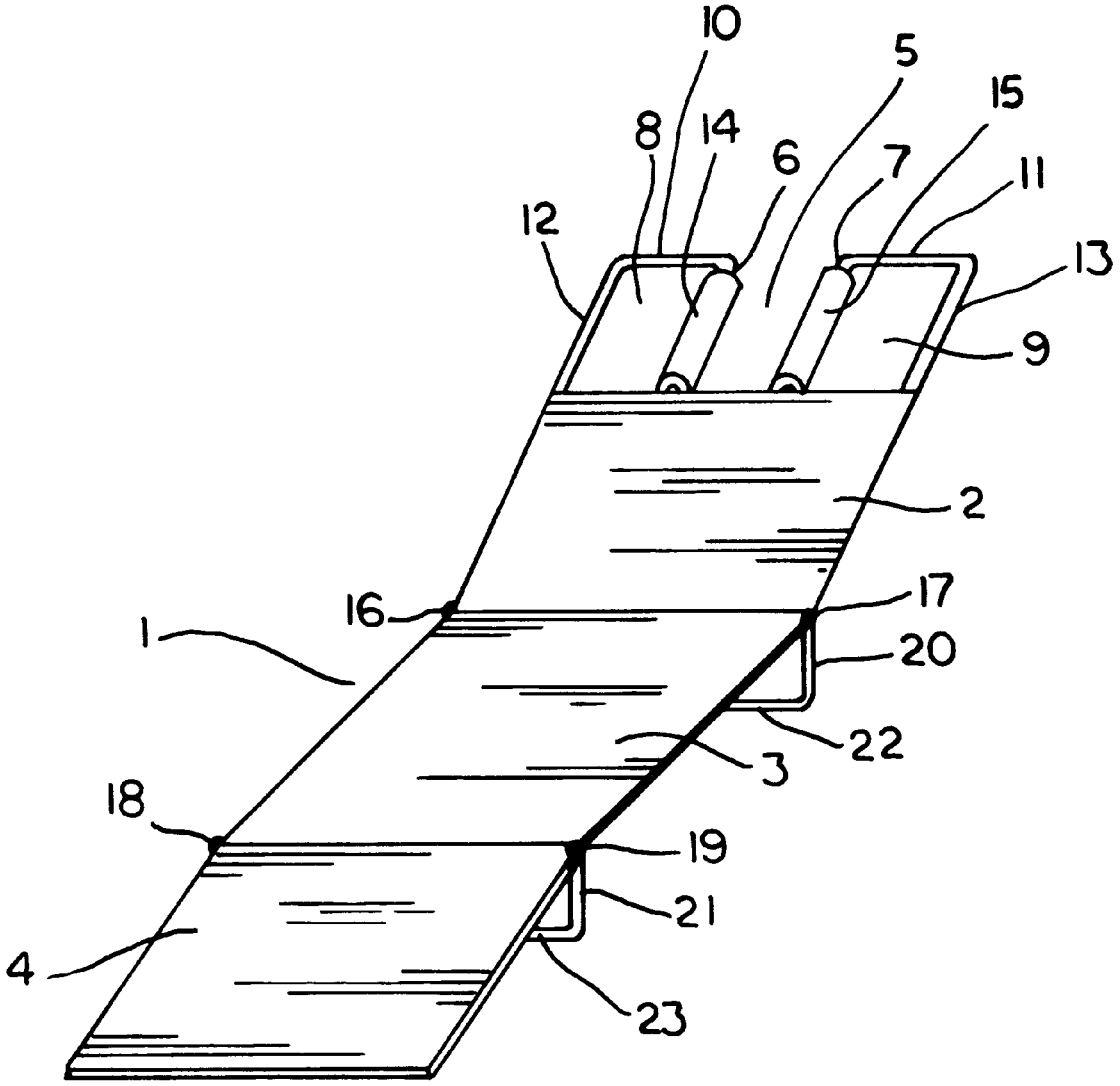
FIG. 1 is an orthographic view of the improved lounge chair in an unfolded position. An elongated opening as well as vent openings are shown in the Figure.

Referring now to FIG. 1, a lounge chair apparatus for supporting a person in either a prone, supine or sitting position referred to generally by reference numeral 1 is made up generally of an upper platform 2, a middle platform 3, and a lower platform 4. The upper platform 2 is generally made for supporting the upper body portion of a person. The middle platform 3 and lower platform 4 are made for supporting the middle and lower body portions of a person's body respectively.

The lower platform 4 is pivotally affixed to the middle platform 3 by means of ratchet hinges 18 and 19. Similarly, the middle platform 3 is pivotally affixed to the upper platform 2 by means of ratchet hinges 16 and 17. Supporting the lounge chair apparatus 1 above the ground a given distance are vertical support legs 20 and 21. A pair of horizontal support legs 22 and 23 are further connected to the support legs 20 and 21 for additional stability. Normally, the horizontal support legs 22 and 23 are affixed thereto the vertical support legs 20 and 21 at the bottom such that the horizontal support legs 22 and 23 are lying on the ground.

At one end of the upper platform 2 in FIG. 1, are a plurality of support members affixed thereto. The plurality of support members form a pair of U-shaped configurations with each open end of the U-shaped configurations affixed thereto the upper platform. An integral pair of parallel facial support member 6 and 7 from the U-shaped configurations extend from the end of the upper platform 2 in a substantially perpendicular fashion. The facial support members 6 and 7 are separated from each other a given distance normally equal to the width of an average person's cheekbones. Affixed to the end of the facial support members 6 and 7 in a substantially perpendicular fashion are support members 10 and 11. Also, affixed to the end of the support members 10 and 11 in a substantially perpendicular fashion and arranged parallel to facial support members 6 and 7 are support members 12 and 13.

Affixed thereto the facial support members 6 and 7 in FIG. 1 are a pair of cushion supports 14 and 15 respectively for supporting either a person's face or head. The cushion supports 14 and 15 are generally tubular in construction with a hollow center for accommodating facial support members 6 and 7.

In FIG. 1, an elongated slot 5 generally having a U-shaped configuration is formed by the upper platform 2, and facial support members 6 and 7. The elongated slot 5 is designed to allow a person's face to fit therein a given distance. Adjacent to the elongated slot 5 are a pair of vent openings 8 and 9 for allowing air to circulate freely around the head area of a person. The vent openings are generally rectangular in structure and are bordered or formed by facial support members 6 and 7, support members 10 and 11, support members 12 and 13, and the upper platform 2.

Figure 2:
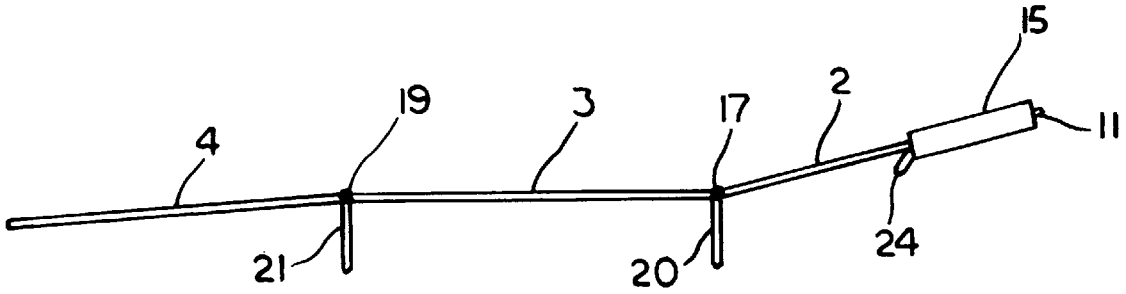
FIG. 2 shows a side view of the invention in an unfolded position whereby a protruding handle can be seen at the lower side.

Referring now to FIG. 2, we see a side view of the lounge chair apparatus 1 in an unfolded position. In the vicinity of the upper platform 2, a protruding member can be seen forming a carrying handle 24 for allowing a person to grasp onto when transporting the apparatus 1. The handle 24 is affixed thereto both facial support members 6 and 7 in a substantially perpendicular fashion and thus give additional structural support to the apparatus 1.

Figure 3:
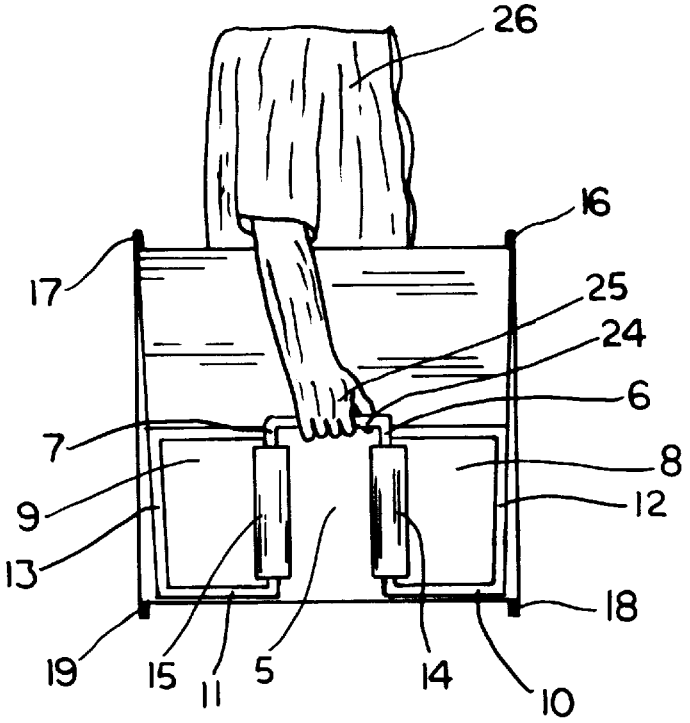
FIG. 3 shows the invention in a folded position with a person carrying the chair using the protruding handle provided.

In FIG. 3, the apparatus 1 is shown in a completely folded position with a person's hand 25 carrying the apparatus 1 via the carrying handle 24.

Figure 4:
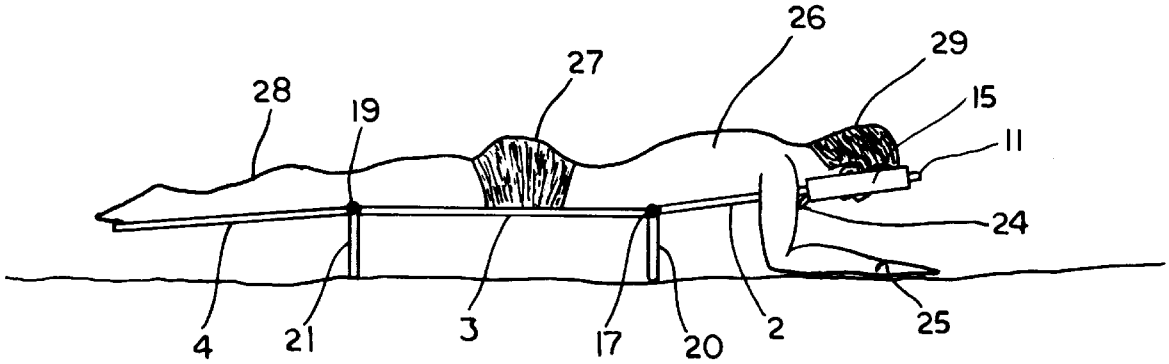
FIG. 4 shows a side view of the invention in an unfolded position with a person lying thereon the lounge chair. The person's face is shown resting thereon the facial supports.

In FIG. 4, a side view of the apparatus is shown in an unfolded fashion having a person lying in a prone fashion thereon. The upper body portion 26 of the person is being supported by upper platform 2. The middle body portion 27 of the person is supported by middle platform 3 and similarly, the lower body portion 28 or legs of the person is supported by lower platform 4. The head portion 29 of the person is shown in a face down or prone position with the person's face being supported by facial support members 6 and 7. If the person wishes to lye in a supine position, the back of the person's head 29 will rest therebetween the facial support members 6 and 7.

Figure 5:
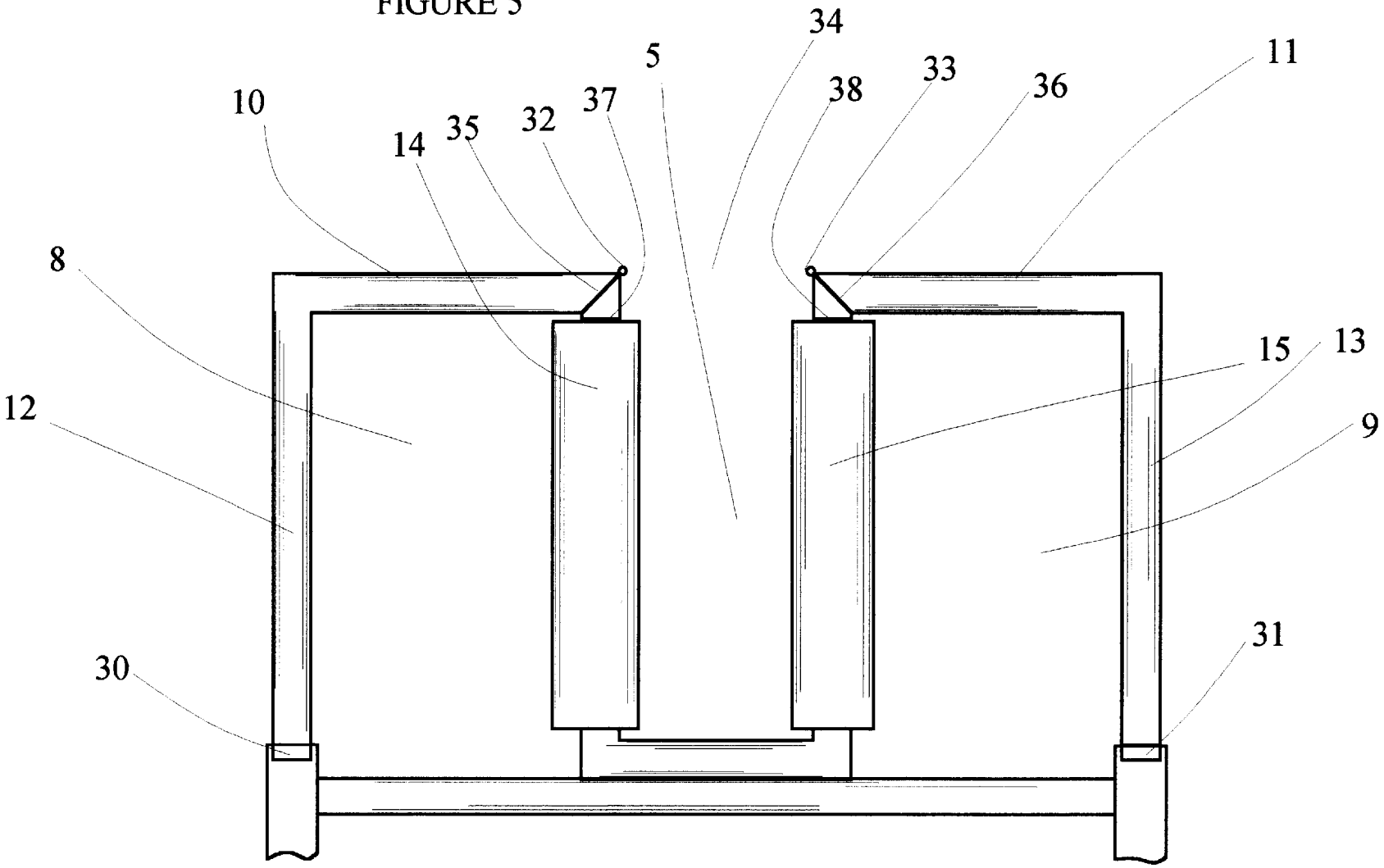
FIG. 5 shows a top view of the cushion and vent section with the members in a standard and tucked position.
Figure 6:
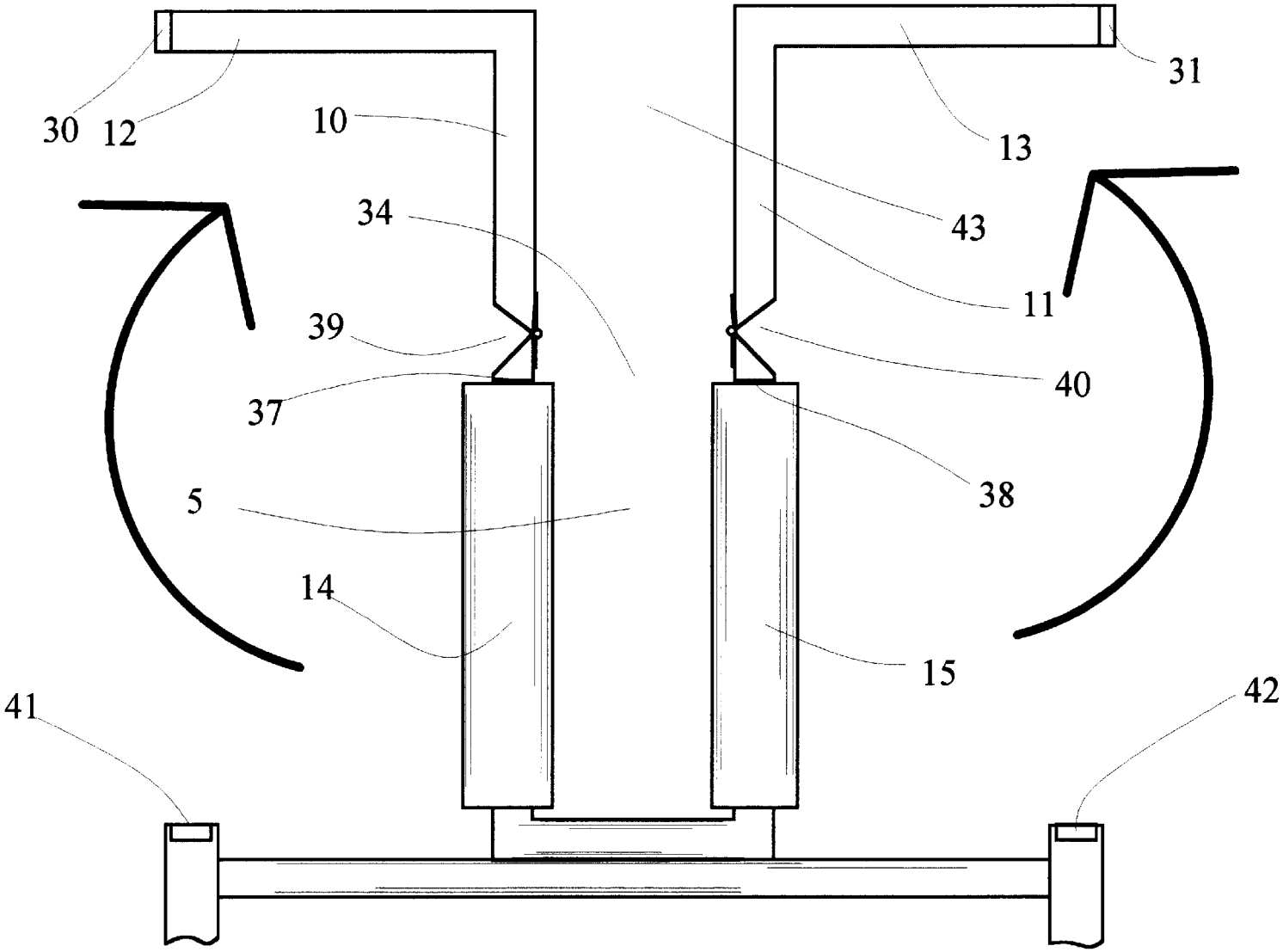
FIG. 6 shows a top view of the cushion and vent section with the top members in a fully extended position and parallel to the cushions.
Figure 7:
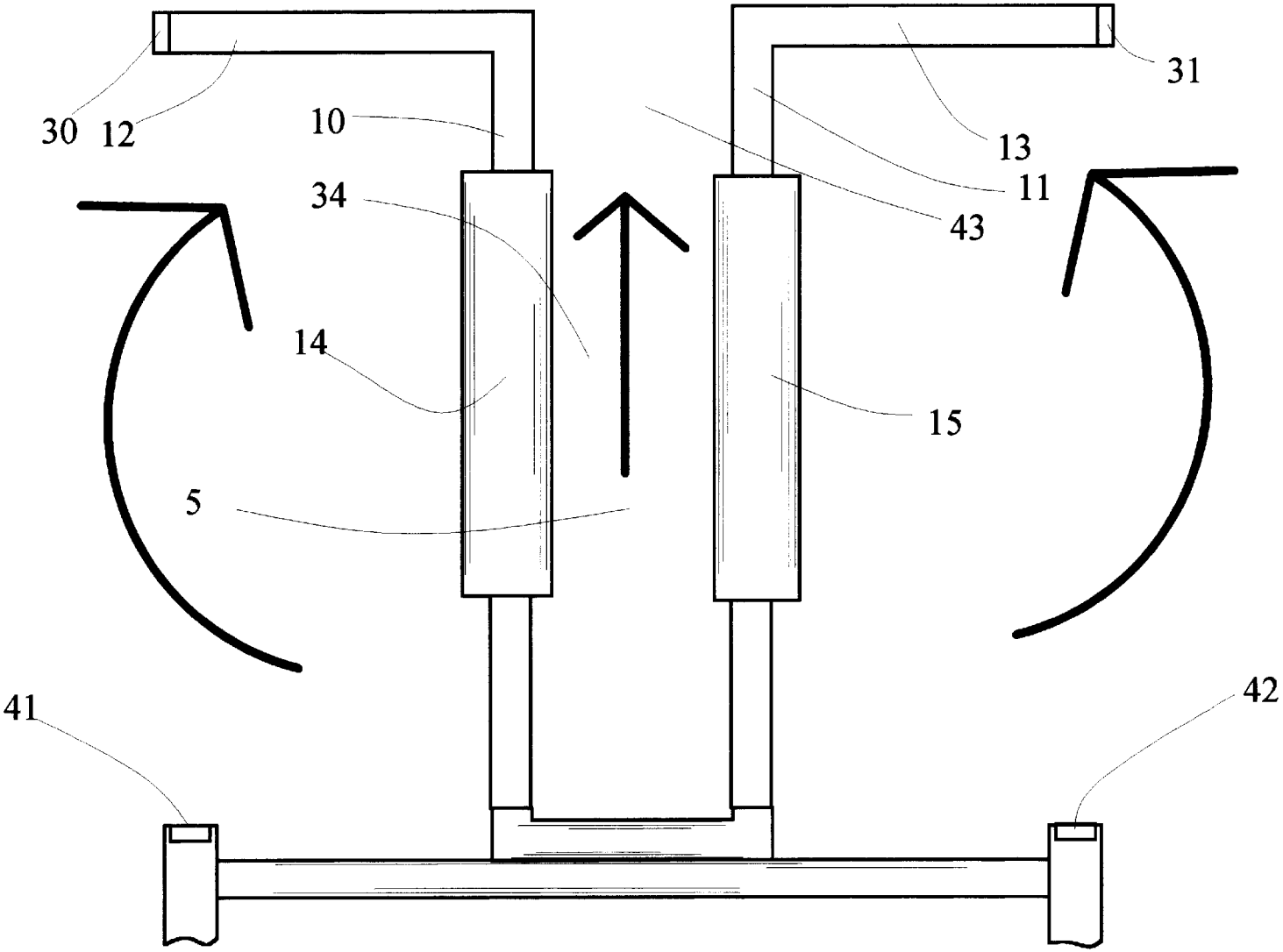
FIG. 7 shows a top view of the cushion section and vent section with the members in a fully extended position and the cushions slid a given distance upwards to cover the hinges.
Figure 8:
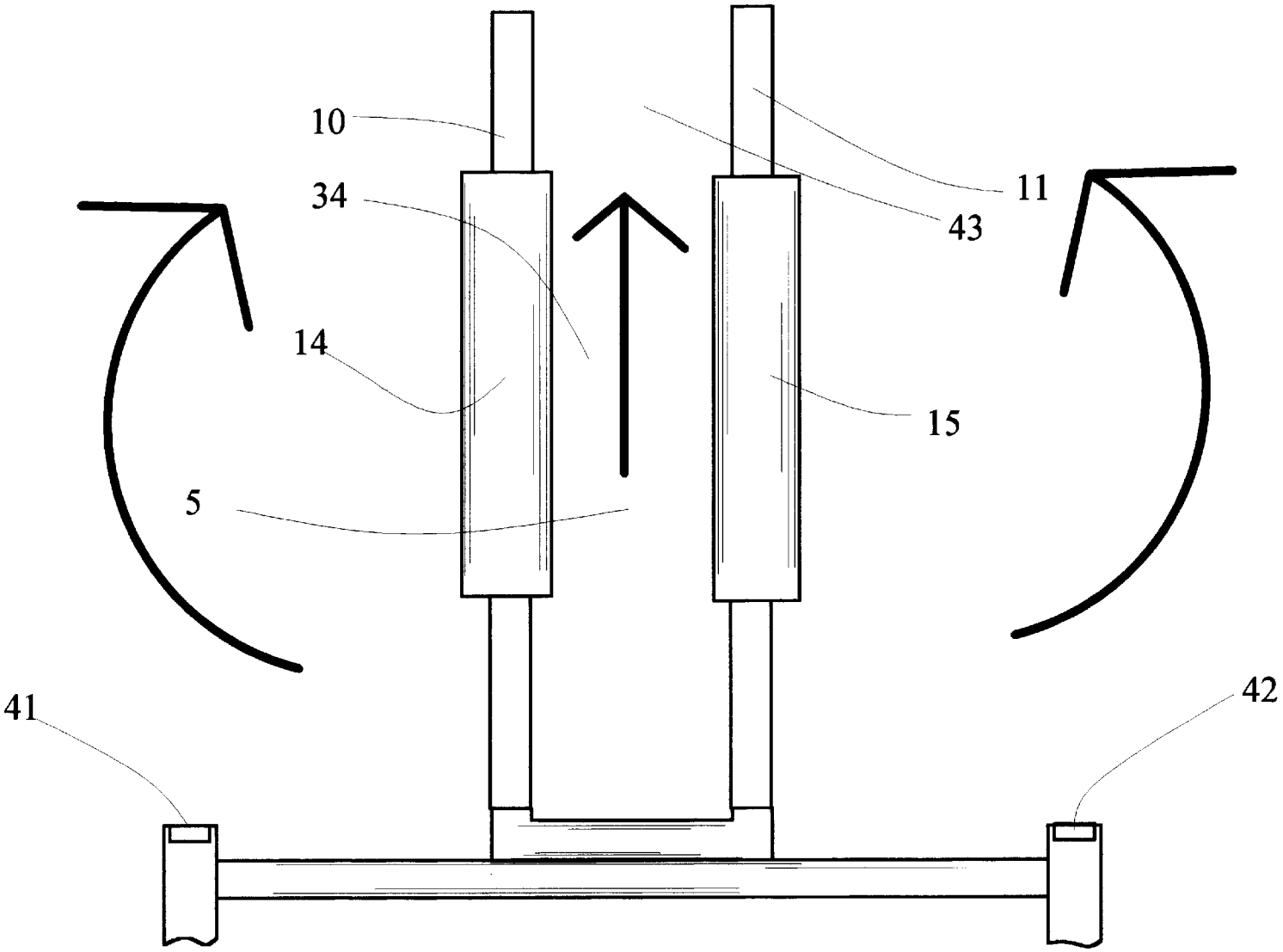
FIG. 8 shows a top view of the cushion and vent section with the members in a fully extended position with the cushion slid upwards and the distal supporting members twisted toward the floor to form legs.
Figure 9:
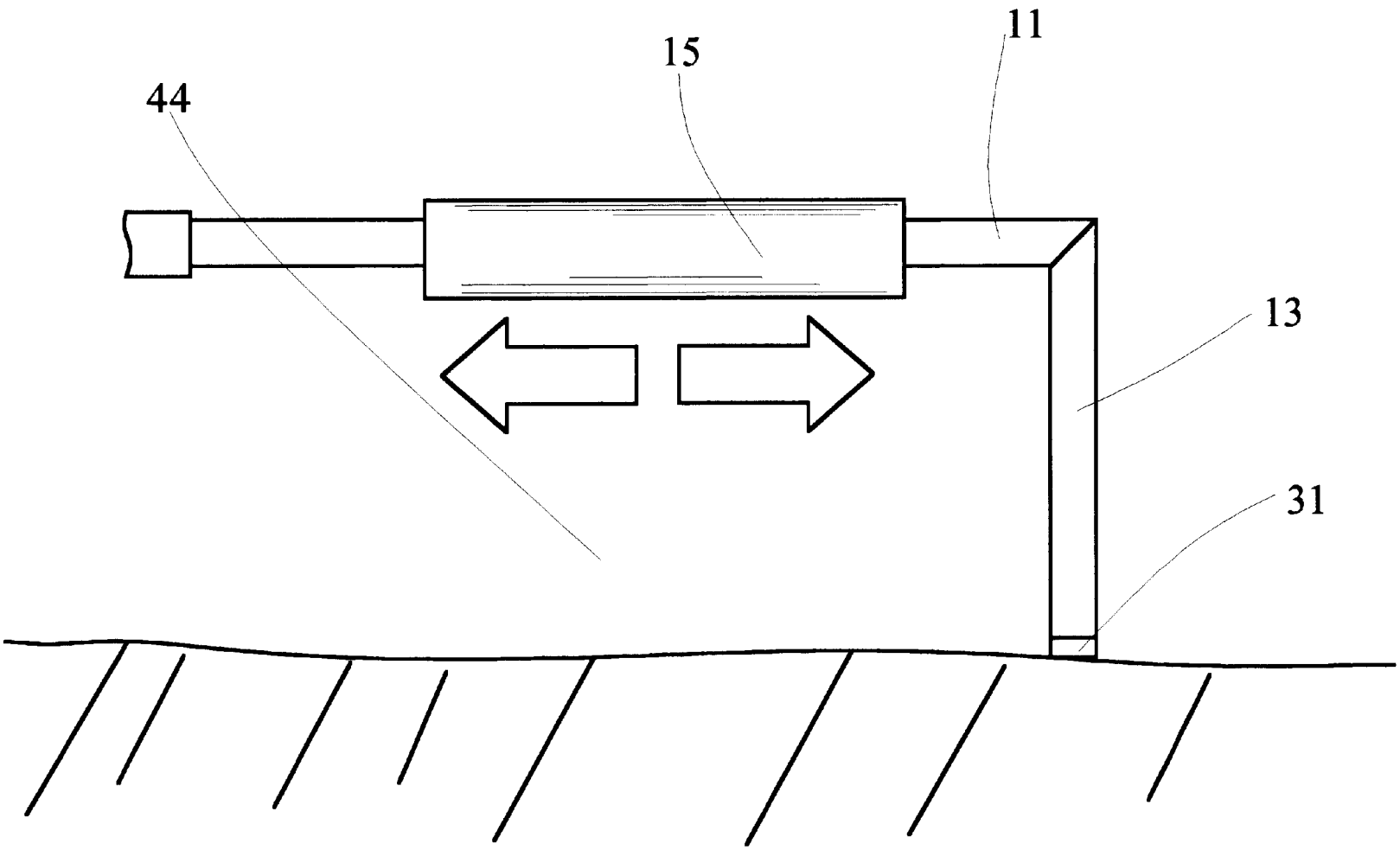
FIG. 9 shows a side view of the invention displaying how the distal members form supporting legs against the ground.

Referring to FIG. 5–9, we see an additional feature that allows for adjustment in the horizontal plane for taller people. FIG. 5 shows hinges 32 and 33 and locking cavities 41 and 42 for allowing the supporting members 10, 11, 12, and 13 to swing open and align with cushion members 14 and 15 as in FIG. 6. In FIG. 6, the members 19, 11, 12, and 13 are in a fully open position, whereby cushion members 14 and 15 can slide over hinges 32, and 33 and lock the members into the open position as in FIG. 7. With the cushion member 14 and 15 at the top position, an extended facial opening 43 is created. The extended members 10 and 11 need more support in this extended position, thus members 12 and 13 are rotated downward about rotating means 37 and 38 to neatly form legs 12 and 13 as in FIG. 8 and 9.

In carrying out this invention in the illustrative embodiment thereof, a person simply unfolds the vertical support legs 21 and 26, the upper platform 2 and lower platform 4 as shown in FIGS. 1, 2, and 4 to an appropriate position. Next, the person lyes down either in a prone or supine position and rest their face or back of their head 29 thereon the facial support members 6 and 7 or by pulling up on upper platform 2, a person may sit in an upright position at varying degrees.

Accordingly, a very unique, attractive, and convenient lounge chair apparatus is provided for allowing a person to lye in either a prone or a supine position while sun bathing.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A lounge chair apparatus for supporting a person, said apparatus comprising:

a. an upper platform having a substantially rectangular configuration with a top edge, two lateral edges and a bottom edge, b. a pair of facial support members affixed to said top edge in a substantially perpendicular fashion, said facial support members having a top end, and a bottom end, c. a pair of upper support members pivotally and rotatably affixed to said facial support members in a substantially outward perpendicular fashion, d. a pair of middle support members affixed to said upper support members in a substantially perpendicular fashion, said middle support members having a top end and a bottom end, said bottom end removeably affixed to said top edge of said upper platform, e. a middle platform pivotally affixed to said upper platform, f. a lower platform pivotally affixed to said middle platform.

2. A lounge chair apparatus as set forth in claim 1 wherein said facial support members form a carrying handle when in a folded position.

3. A lounge chair apparatus as set forth in claim 1 wherein said facial support members having a cushion means affixed thereto.

4. A lounge chair apparatus as set forth in claim 1 further having a support leg pivotally affixed therebetween said upper platform and said middle platform and therebetween said middle platform and said lower platform thereby supporting said chair apparatus above the ground.

5. A lounge chair apparatus for supporting a person, said apparatus comprising:

(a) an upper platform having a substantially rectangular configuration, said upper platform having a plurality of support members affixed thereto, said support members forming a pair of first and second U-shaped configurations, the open end of said first and second U-shaped configurations affixed to said upper platform at one end, said first and second U-shaped configurations separated a given distance from each other, said first and second U-shaped configurations having one facial support member affixed thereto, both said facial support members arranged in parallel to each other, (b) a middle platform having a substantially rectangular configuration, said middle platform pivotally affixed to said upper platform at one end opposite the end of said U-shaped configuration, (c) a lower platform having a substantially rectangular configuration, said lower platform pivotally affixed to said middle platform at one end opposite the end of said upper platform.

6. A lounge chair apparatus as set forth in claim 5 wherein said first and second U-shaped configurations having a carrying handle affixed thereto.

7. A lounge chair apparatus as set forth in claim 6 wherein said carrying handle extends outwardly from said upper platform a given distance.

8. A lounge chair apparatus as set forth in claim 5 wherein said facial support members having a cushion means affixed thereto.

9. A lounge chair apparatus as set forth in claim 5 further having a support leg pivotally affixed between said upper platform and said middle platform and between said middle platform and said lower platform thereby supporting said chair apparatus above the ground.

10. A lounge chair apparatus as set forth in claim 5 wherein said first and second U-shaped configurations having a vent opening therein for allowing air to flow therethrough.

* * * * *